US005545513A

United States Patent [19]

Edwards

[11] Patent Number: 5,545,513

[45] **Date of Patent: * Aug. 13, 1996**

[54] PHOTOGRAPHIC MATERIAL WITH IMPROVED GRANULARITY

[75] Inventor: Larry D. Edwards, Rochester, N.Y.

[73] Assignee: Eastman Kodak Company, Rochester, N.Y.

[ * ] Notice: The portion of the term of this patent subsequent to Apr. 28, 2009, has been disclaimed.

[21] Appl. No.: 75,968

[22] Filed: Jun. 11, 1993

Related U.S. Application Data

[63] Continuation-in-part of Ser. No. 886,278, May 20, 1992, abandoned.

[51] Int. Cl.[6] ..... G03C 7/30; G03C 7/32; G03C 7/333

[52] U.S. Cl. ..... 430/506; 430/505; 430/544; 430/955; 430/957; 430/385; 430/389; 430/387; 430/553; 430/557; 430/558; 430/504; 430/507; 430/567

[58] Field of Search ..... 430/506, 505, 430/544, 955, 957, 385, 389, 387, 553, 557, 558, 504, 507, 567

[56] References Cited

U.S. PATENT DOCUMENTS

| | | | |
|---|---|---|---|
| 3,843,369 | 10/1974 | Kinnai et al. | 430/504 |
| 4,184,876 | 1/1980 | Eeles et al. | 430/505 |
| 4,186,016 | 1/1980 | Lohmann et al. | 430/506 |
| 4,490,459 | 12/1984 | Iijima et al. | 430/505 |
| 4,511,648 | 4/1985 | Yamashita et al. | 430/506 |
| 4,564,587 | 1/1986 | Watanabe et al. | 430/505 |
| 4,567,135 | 1/1986 | Arakawa et al. | 430/505 |
| 4,582,780 | 4/1986 | Giusto et al. | 430/509 |
| 4,599,302 | 7/1986 | Scheerer | 430/567 |
| 4,670,375 | 6/1987 | Michiue et al. | 430/509 |
| 4,724,198 | 2/1988 | Yamada et al. | 430/506 |
| 4,777,122 | 10/1988 | Beltramini | 430/502 |
| 4,833,070 | 5/1989 | Kunitz et al. | 430/505 |
| 4,840,880 | 5/1989 | Ohlschlarer et al. | 430/505 |
| 4,897,341 | 1/1990 | Odenwalder et al. | 430/544 |
| 5,190,851 | 3/1993 | Chari et al. | 430/505 |
| 5,372,920 | 12/1994 | Edwards | 430/505 |

FOREIGN PATENT DOCUMENTS

| | | | |
|---|---|---|---|
| 0107112 | 5/1984 | European Pat. Off. . | |
| 3413800 | 10/1985 | Germany . | |
| 3418749 | 11/1985 | Germany . | |
| 57-63532 | 4/1982 | Japan . | |
| 63-226651 | 9/1988 | Japan . | |
| 1-52145 | 2/1989 | Japan . | |
| 3-238449 | 10/1991 | Japan | 430/506 |

*Primary Examiner*—Mark F. Huff
*Attorney, Agent, or Firm*—Arthur E. Kluegel

[57] ABSTRACT

A multilayered color photographic element contains a support having coated thereon photographic silver halide emulsion layers including at least three layers each having the same spectral sensitivity but having, respectively, the most, mid, and least light sensitivity wherein the most and mid sensitive layers are contiguous and the most sensitive layer is extremely starved of image dye-forming coupler.

20 Claims, No Drawings

PHOTOGRAPHIC MATERIAL WITH IMPROVED GRANULARITY

This application is a continuation-in-part of application Ser. No. 886,278 filed May 20, 1992, now abandoned.

This invention relates to a photographic material having multiple color layers comprising a red sensitive layer which is a coupler starved layer and which is free of cyan image dye-forming coupler.

Color photographic material comprising multiple layers containing photographic couplers are well known. Typical photographic materials are described is U.S. Pat. Nos. 4,724,198; 4,184,876; 4,186,016; and 4,273,861.

Prior photographic materials have exhibited sharpness and granularity problems particularly granularity when lower silver levels are used. Granularity problems are more severe especially when low contrast is needed. That is, when the amount of silver is lowered, higher levels of granularity are experienced because the lower silver level results in fewer developable sites.

Various ways are recognized in the photographic art for improving granularity. However, these improvements have not been without problems. For example, often the improvement in granularity has been at the expense of other properties such as sharpness and color.

The present invention solves these types of problems by providing a multilayered color photographic element comprising a support having coated thereon photographic silver halide emulsion layers said layers including at least three layers each having the same spectral sensitivity but having, respectively, the most, mid, and least light sensitivity wherein the most and mid sensitive layers are contiguous and the most sensitive layer is extremely starved of image dye-forming coupler. As used in the present invention, when layers are said to have the same spectral senitivity, it is meant that they are sensitized within the same spectral range e.g. red, green or blue.

The photographic element may be processed to form a developed image in an exposed color photographic element by developing the element with a color developer.

In one embodiment, the element contains in the fast layer amounts of image dye-forming coupler and silver halide (expressed as silver) in a weight ratio of less than 0.1, and this level is referred to herein as "extreme" coupler starvation. In even more starved arrangements, the ratio may be less than 0.05, less than 0.03, less than 0.01 and in some cases the most sensitive layer may be substantially free of image dye-forming coupler. There may be present in the layer couplers with PUGs (which may form some dye of the desired or of another color upon coupling) and there may be color correction couplers which form a dye of a different color, with or without PUGs.

Where these other couplers are present, it is suitable that the combined weight ratio of the total of all the dye-forming couplers to silver in the layer is less than 0.30. Color correction couplers and those containing PUGs useful for development inhibition, masking and process sensitivity control are particularly useful.

The most and mid sensitive layers are contiguous. This permits the oxidized developer formed in the most sensitive layer to migrate to the interface with the mid layer during development and to there come into contact with image dye-forming coupler to form dye of the desired color. If the two layers are not contiguous, this result is not accomplished. The effect of this migration is to permit the oxidized developer to travel some distance from the silver halide grain where it was formed before it finds and reacts with a cyan image dye-forming coupler. Since the fast layer requires the largest grain structure for speed, it is the layer most responsible for poor granularity. The invention provides improved granularity when compared to a standard three layer arrangement and when compared to a two layer arrangement having a coupler starved fast layer.

The principle of the invention is applicable in any triple coat application. It is useful in blue, green or red records. In particular, it is useful in the green or red records where the need for larger grain sizes often presents more pronounced granularity problems.

The invention is particularly useful where at least two of the most sensitive layers of different color sensitivity are adjacent (without an intervening light sensitive layer) and is useful where all three most sensitive layers are located in a position adjacent to at least one other most sensitive layer.

In a more specific embodiment, the invention provides a multilayer photographic element comprising a support having coated thereon photographic silver halide emulsion layers comprising at least one image dye-forming coupler, the element being comprised of a plurality of blue sensitive silver halide emulsion layers, with one of the blue sensitive layers being more sensitive than another blue sensitive layer, at least three red sensitive silver halide emulsion layers having a first red sensitive layer being more sensitive than a second or mid red sensitive layer which is more sensitive than a third red sensitive layer, a plurality of green sensitive silver halide emulsion layers with one of the green sensitive layers being more sensitive than another slower green sensitive layer, the layers arranged with (a) the least sensitive red layer being a photographic emulsion layer closest to the support (b) the least sensitive green layer adjacent said least sensitive red layer (c) the mid red sensitive layer adjacent said least sensitive green layer and contiguous said most sensitive red layer and (d) the most sensitive red layer being a coupler starved layer and being free of cyan image dye-forming coupler. In the photographic element the blue sensitive halide layers are the emulsion layers farthest from the support. The most sensitive blue layer can be farthest from the support but preferably the less sensitive blue layer is the emulsion layer farthest from the support. By adjacent is meant that the layer may be contiguous or separated by non-photographic emulsion layers.

A typical photographic element in accordance with the invention typically comprises the following layer order:

OVERCOAT
UV
LEAST BLUE SENSITIVE OR SLOW YELLOW
MOST BLUE SENSITIVE OR FAST YELLOW
INTERLAYER
MOST GREEN SENSITIVE OR FAST MAGENTA
INTERLAYER
MOST RED SENSITIVE OR FAST CYAN
MID RED SENSITIVE OR MID CYAN
INTERLAYER
LEAST GREEN SENSITIVE OR SLOW MAGENTA
INTERLAYER
LEAST RED SENSITIVE OR SLOW CYAN
INTERLAYER
ANTIHALATION LAYER
SUPPORT

The image dye-forming couplers in the blue-sensitive, green-sensitive and red sensitive layers as described can be any of the image dye-forming couplers known in the photographic art for such layers for forming yellow, magenta and cyan dye images. Such couplers can comprise a coupler moiety (COUP) known in the art and as described. Combinations of the image dye-forming couplers can be useful in the described photographic silver halide emulsion layers.

Image dye-forming couplers in accordance with the invention are those which function primarily to couple with oxidized developer to form a dye where an image is present having a color corresponding to the sensitivity of the layer in which they are located. Couplers which form an image dye of a different color. sometimes referred to as color correction couplers, are not included within the term "image dye-forming coupler" as that term is used herein. They may be 4-equivalent or 2-equivalent. In 4-equivalent couplers, there is no coupling-off group and the oxidized developer couples with the coupler by replacement of a hydrogen. In 2-equivalent couplers, there is a releasable substituent other than hydrogen at the coupling position of the coupler parent (COUP.) While this substituent or coupling-off group (COG) may be selected so as to affect dye formation characteristics and/or dye properties, it is not a dye or other photographically useful group (PUG.).

Couplers having a COG which is a dye or other PUG are well known in the art. Examples or releasable PUGs include a dye, a development inhibitor, a development accelerator, a bleach inhibitor, a bleach accelerator, an electron transfer agent, a coupler (for example, a competing coupler, a dye-forming coupler, or a development inhibitor releasing coupler, a dye precursor, a dye, a developing agent (for example, a competing developing agent, a dye-forming developing agent, or a silver halide developing agent), a silver complexing agent, a fixing agent, an image toner, a stabilizer, a hardener, a tanning agent, a fogging agent, an ultraviolet radiation absorber, an antifoggant, a nucleator, a chemical or spectral sensitizer, or a desensitizer.

The couplers that are cyan image dye-forming couplers are typically phenols or naphthols, such as described in the photographic art for forming cyan dyes upon oxidative coupling.

Examples of such couplers that form cyan dyes are typically phenols and naphthols that are described in such representative patents and publications as: U.S. Pat. Nos. 2,772,162; 3,772,002; 4,526,864; 4,500,635; 4,254,212; 4,296,200; 4,457,559; 2,895,826; 3,002,936; 3,002,836; 3,034,892; 2,474,293; 2,423,730; 2,367,531; 3,041,236; 4,443,536; 4,124,396; 4,775,616; 3,779,763; 4,333,999 and "Farbkuppler: Eine Literatürbersicht", published in Agfa Mitteilungen, Band III, pages 156–175 (1961).

The couplers that are magenta image dye-forming couplers are typically pyrazolones, pyrazolotriazoles and benzimidazoles such as described in the photographic art for forming magenta dyes upon oxidative coupling.

The couplers that are magenta image dye-forming couplers are typically pyrazolones, pyrazolotriazoles and benzimidazoles, such couplers are described in such representative patents and publications as U.S. Pat. Nos. 2,600,788; 2,369,489; 2,343,703; 2,311,082; 3,824,250; 3,615,502; 4,076,533; 3,152,896; 3,519,429; 3,062,653; 2,908,573; 4,540,654; 4,443,536; 3,935,015; and European Applications 284,239; 284,240; 240,852; 177,765 and "Farbkuppler: Eine Literaturbersicht" published in Agfa Mitteilungen, Band III, pages 126–156 (1961), the disclosure of which is incorporated herein by reference.

Couplers that are yellow dye forming couplers are typically acytacetamides, such as benzoylacetanilides and pivalylacetanilides. Such couplers are described in such representative patents and publications as: U.S. Pat. Nos. 2,875,057; 2,407,210; 3,265,506; 2,298,443; 3,048,194; 4,022,620; 4,443,536; 3,447,928 and "Farbkuppler: Eine Literat ürbersicht", published in Agfa Mitteilungen, Band III, pages 112–126 (1961).

A photographic element in accordance with the invention might have the following configuration:

OVERCOAT LAYER

The overcoat layer can combine a single or double layer. This layer can contain components known in the photographic art for overcoat layers and can contain UV absorbers, matting agents, surfactants, and like. This layer, for example, can also comprise a dye which can help in adjusting the photographic sensitivity of the element.

SLOW YELLOW LAYER

In the photographic element, the least sensitive blue or slow yellow layer contains a yellow image dye-forming coupler and a bleach accelerator releasing coupler.

The yellow image dye-forming coupler can be any yellow image dye-forming coupler useful in the photographic art. Couplers that are yellow image dye-forming couplers are typically acylacetamides, such as benzoylacetanilides and pivalylacetanilides, such as described in the photographic art for forming yellow dyes upon oxidative coupling.

The class of yellow image dye-forming couplers characterized as benzoylacetanilide couplers is illustrated by those described in, for example U.S. Pat. Nos. 4,022,620 and 4,980,267, the disclosure of which is incorporated herein by reference. A typical example of such a coupler is illustrated by the formula:

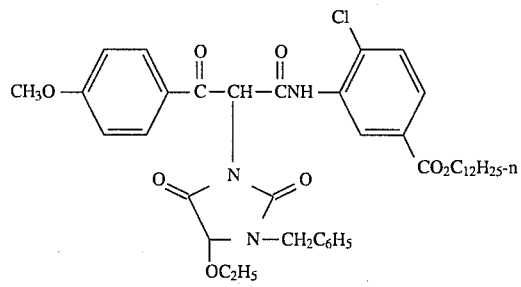

(8)

The class of yellow image dye-forming couplers characterized as pivalylacetanilide couplers is illustrated by those described in, for example U.S. Pat. No. 3,933,501 and comprise a phenoxy coupling off group, the disclosure of which is incorporated herein by reference. Such a coupler is represented by the formula:

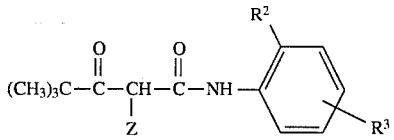

wherein $R^2$ is chlorine, bromine or alkoxy;

$R^3$ is a ballast group, such as a sulfonamide or carboxamide ballast group; and Z is a coupling-off group, preferably a phenoxy or substituted phenoxy coupling off group. The yellow image dye-forming coupler in the least sensitive blue layer is typically a coupler which is more reactive than the yellow image dye-forming coupler in the most sensitive blue layer.

A preferred yellow image dye-forming coupler is:

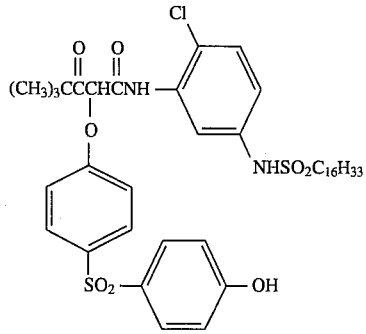

(24)

The bleach accelerator releasing coupler (BARC) can be any bleach accelerator releasing coupler know in the photographic art. Combinations of such couplers are also useful. The bleach accelerator releasing coupler can be represented by the formula:

$$\text{COUP}+T^2\rfloor_m S-R^3-R^4$$

wherein

COUP is a coupler moiety as described, typically a cyan, magenta, or yellow dye-forming coupler moiety;

$T^2$ is a timing group known in the photographic art, typically a timing group as described in U.S. Pat. Nos. 4,248,962 and 4,409,323, the disclosures of which are incorporated herein by reference;

m is either 0 or 1;

$R^3$ is an alkylene group, especially a branched or straight chain alkylene group, containing 1 to 8 carbon atoms; and $R^4$ is a water-solubilizing group, preferably a carboxy group. Typical bleach accelerator releasing couplers are described in, for example, European Patent 193,389, the disclosure of which is incorporated herein by reference.

A preferred bleach accelerator releasing coupler is:

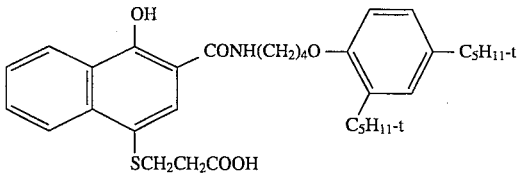

(7)

FAST YELLOW LAYER

In the photographic element, the most sensitive blue or fast yellow layer contains a yellow image dye-forming coupler, a development inhibitor releasing coupler (DIR), and/or a timed development inhibitor releasing coupler (DIAR) and a bleach accelerator releasing coupler.

The yellow image dye-forming coupler can be any yellow image dye-forming coupler useful in the photographic art. Typically, the yellow image dye-forming coupler in the most sensitive blue layer is preferably less reactive than the yellow image dye-forming coupler in the least sensitive blue layer. Suitable yellow image dye-forming couplers useful in the invention are as described with respect to such slow yellow layer, with the preferred coupler illustrated by the formula:

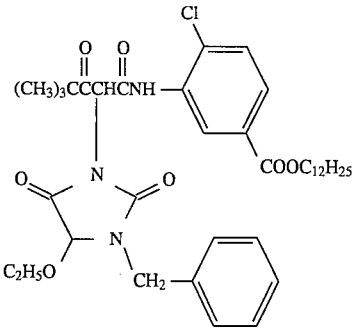

(16)

The development inhibitor releasing coupler in the fast yellow layer can be any DIR known in the photographic art. Typical DIR couplers are described in, for example, U.K. Patent 2,099,167, the disclosure of which is incorporated herein by reference. Such DIR couplers upon oxidative coupling preferably do not contain a group that times or delays release of the development inhibitor group. The DIR coupler is typically represented by the formula:

COUP-INH wherein:

COUP is a coupler moiety, and

INH is a releasable development inhibitor group that is bonded to the coupler moiety at a coupling position. The coupler moiety, COUP, can be any coupler moiety that is capable of releasing the INH group upon oxidative coupling.

The coupler moiety, COUP, is for example, a cyan, magenta, or yellow forming coupler known in the photographic art. The COUP can be ballasted with a ballast group known in the photographic art. The COUP can also be monomeric, or it can form part of a dimeric, oligomeric or polymeric coupler, in which case more than one inhibitor group can be contained in the DIR coupler.

The releasable development inhibitor group, INH, can be any development inhibitor group known in the photographic art. Examples, include those described, in for example, U.S. Pat. Nos. 4,248,962; 3,227,554; 3,384,657; 3,615,506; 3,617,291; 3,733,202; and U.K. 1,450,479. Illustrative INH groups include: mercaptotetrazoles, selenotetrazoles, mercaptobenzothiazoles, selenobenzothiazoles, mercaptobenzimidazoles, selenobenzimidazoles mercaptobenzoxazoles, selenobenzoxazoles, mercaptooxadiazoles, mercaptothiadiazoles, benzotriazoles, benzodiazoles, mercaptotriazoles, 1,2,4-triazoles, tetrazoles, and imidazoles. Preferred inhibitor groups are mercaptotetrazoles and benzotriazoles. Particularly preferred inhibitor groups are described in, for example, U.S. Pat. Nos. 4,477,563 and 4,782,012, the disclosure of which are incorporated herein by reference. A typical DIR coupler within COUP-INH is:

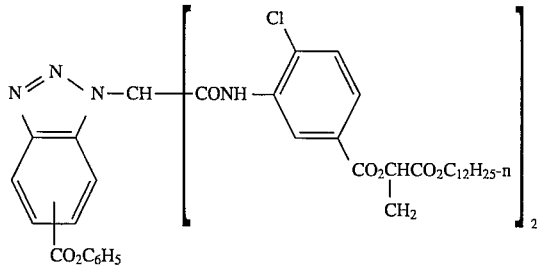

(26)

The DIAR which can be used can be any DIAR which will provide a timed development inhibitor release. That is, a development inhibitor releasing coupler containing at least one timing group (T) that enables timing of release of the development inhibitor group can be any development inhibitor releasing coupler containing at least one timing group known in the photographic art. The development inhibitor releasing coupler containing at least one timing group is represented by the formula:

$$\text{COUP-T}\left[\text{T}^1\right]_n\text{Q}^1$$

wherein: COUP is a coupler moiety, as described, typically a cyan, magenta, or yellow dye-forming coupler moiety;

T and $T^1$ individually are timing groups, typically a timing group as described in U.S. Pat. Nos. 4,248,962 and 4,409,232, the disclosure of which are incorporated herein by reference;

n is 0 or 1;

$Q^1$ is a releasable development inhibitor group known in the photographic art. $Q^1$ can be selected from the INH group as described.

A preferred coupler of this type is described in U.S. Pat. No. 4,962,018, the disclosure of which is incorporated herein by reference.

The timed DIR coupler is typically a pivalylacetanilide coupler, with a preferred timed DIR coupler illustrated by the formula:

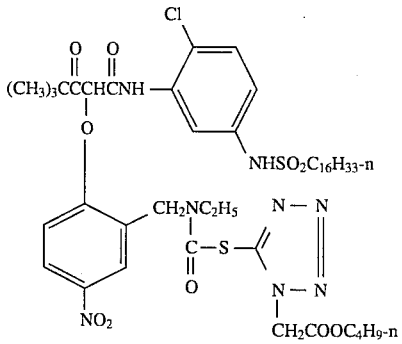

(18)

Suitable bleach accelerator releasing couplers useful in the invention are as described for the slow yellow layer with the preferred compound being the same as described with respect to such slow yellow layer.

INTERLAYER

In the photographic element the interlayer between the fast yellow layer and the fast magenta layer is comprised of Carey Lea silver (CLS) and any oxidized developer scavenger known to the photographic art. Such oxidized developer scavengers are described in U.S. Pat. No. 4,923,787, the disclosure of which is incorporated herein by reference.

A preferred oxidized developer scavenger is:

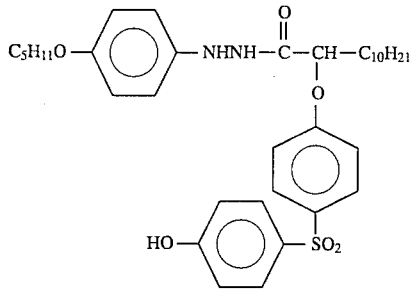

(2)

This layer may also contain dyes to improve image sharpness and/or to tailor photographic sensitivity of the photographic elements below said interlayer.

FAST MAGENTA LAYER

In the photographic element, the most sensitive green layer or fast magenta layer contains a magenta image dye-forming coupler, a development inhibitor releasing coupler (DIR), a timed development inhibitor releasing coupler (DIAR) and a yellow colored color correcting coupler.

The magenta image dye-forming coupler can be any magenta image dye-forming coupler useful in the photographic art.

The couplers that are magenta image dye-forming couplers are typically pyrazolones, pyrazolotriazoles and benzimidazoles, such couplers are described in such representative patents and publications as U.S. Pat. Nos. 2,600,788; 2,369,489; 2,343,703; 2,311,082; 3,824,250; 3,615,502; 4,076,533; 3,152,896; 3,519,429; 3,062,653; 2,908,573; 4,540,654; 4,443,536; 3,935,015; and European Applications 284,239; 284,240; 240,852; 177,765 and "Farbkuppler: Eine Literaturbersicht" published in Agfa Mitteilungen, Band III, pages 126–156 (1961), the disclosure of which is incorporated herein by reference.

A preferred magenta image dye-forming coupler for the magenta layers is:

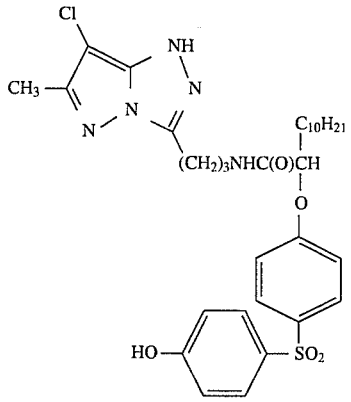

The development inhibitor releasing coupler in the fast magenta layer can be any DIR known in the photographic art. Typical DIR couplers are described in, for example, U.S. Pat. No. 3,227,554, the disclosure of which is incorporated herein by reference. Such DIR couplers upon oxidative coupling preferably do not contain a group that times or delays release of the development inhibitor group. A preferred development inhibitor releasing coupler is:

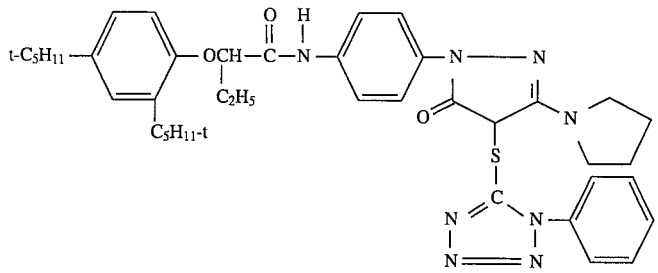

(20)

Suitable timed development inhibitor releasing couplers (DIAR) useful in the invention are as described with respect to such fast yellow layer with the preferred compound being the same as described with respect to such fast yellow layer.

The color correcting coupler in the fast magenta layer can be any color correcting coupler of suitable hue for use in a photographic element. Typically this color correcting coupler is a yellow colored magenta dye-forming coupler, such as described in U.S. Pat. No. 3,519,427, the disclosure of which is incorporated herein by reference. A preferred colored correcting coupler for the fast magenta layer is:

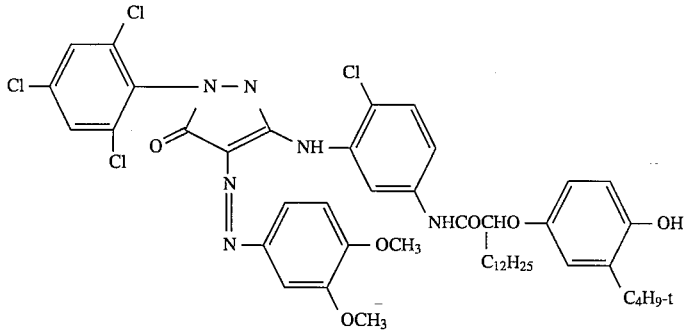

(19)

This layer can also contain dyes to improve image sharpness and/or to tailor photographic sensitivity of the photographic elements below said layer.

INTERLAYER

In the photographic element the interlayer between the fast magenta layer and the fast cyan layer is comprised of any oxidized developer scavenger known in the photographic art. Suitable compounds useful in the invention are as described for the interlayer between the fast yellow layer and the fast magenta layer with the preferred compound being the same as described with respect to such interlayer between the fast yellow layer and the fast magenta layer. This layer can also contain dyes to improve image sharpness and/or to tailor photographic sensitivity of the photographic elements below said layer.

FAST CYAN LAYER

In the photographic element, the most sensitive red layer or fast cyan layer contains a development inhibitor releasing coupler (DIR), a magenta colored color correcting coupler, and a yellow image dye-forming coupler. As noted this layer is a coupler starved layer. The layer is preferably free of an image dye-forming coupler. As used herein by coupler starved is meant a condition in the layer in which there is less dye-forming coupler than is theoretically capable of reacting with all of the oxidized developing agent generated at maximum exposure. Coupler other than image dye-forming couplers can be present in this layer and such couplers can include, for example development inhibitor releasing couplers and color correcting couplers. These other couplers are typically used at concentrations known in the photographic art. A preferred concentration for a DIR is in the range of 0 to 35 mg/m$^2$.

A development inhibitor releasing coupler (DIR) in the fast cyan layer can be any development inhibitor releasing coupler known in the photographic art. Typical DIR couplers are described in, for example, U.S. Pat. Nos. 3,227,554; 3,384,657; 3,615,506; 3,617,291; 3,733,201 and U.K. 1,450,479, the disclosure of which is incorporated herein by reference. Such DIR couplers upon oxidative coupling preferably do not contain a group that times or delays release of the development inhibitor group. The DIR coupler is typically represented by the formula:

COUP-INH wherein: COUP is a coupler moiety, and INH is a releasable development inhibitor group that is bonded to the coupler moiety at a coupling position.

The coupler moiety, COUP, can be any coupler moiety that is capable of releasing the INH group upon oxidative coupling.

The coupler moiety, COUP, is for example, a cyan, magenta, or yellow forming coupler known in the photographic art. The COUP can be ballasted with a ballast group known in the photograhic art. The COUP can also be monomeric, or it can form part of a dimeric, oligomeric or polymeric coupler, in which case more than one inhibitor group can be contained in the DIR coupler.

The releasable development inhibitor group, INH, can be any development inhibitor group known in the photographic art. Examples, include those described, in for example, U.S. Pat. Nos. 4,248,962; 3,227,554; 3,384,657; 3,615,506; 3,617,291; 3,733,202; and U.K. 1,450,479. Illustrative INH groups include: mercaptotetrazoles, selenotetrazoles, mercaptobenzothiazoles, selenobenzathiazoles, mercaptobenzimidazoles, selenobenzimidazoles mercaptobenzoxazoles, selenobenzoxazoles, mercaptooxadiazoles, mercaptothiadiazoles, benzotriazoles, benzodiazoles, mercaptotriazoles, 1,2,4-triazoles, tetrazoles, and imidazoles. Preferred inhibitor groups are mercaptotetrazoles and benzotriazoles. Particularly preferred inhibitor groups are described in, for example, U.S. Pat. Nos. 4,477,563 and 4,782,012, which are incorporated herein by reference. A preferred DIR coupler within COUP-INH is:

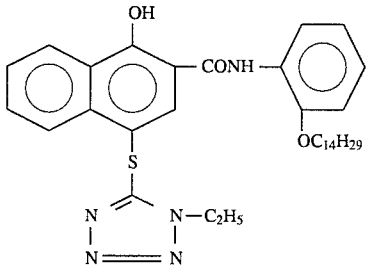

(17)

The color correcting coupler in the fast cyan layer can be any color correcting coupler of suitable hue for use in a photographic element. Typically this color correcting coupler is a magenta colored cyan dye-forming coupler, such as a naphthol cyan dye-forming coupler as described in U.S. Pat. No. 3,476,536, the disclosure of which is incorporated herein by reference. A preferred color correcting coupler for the fast cyan layer is:

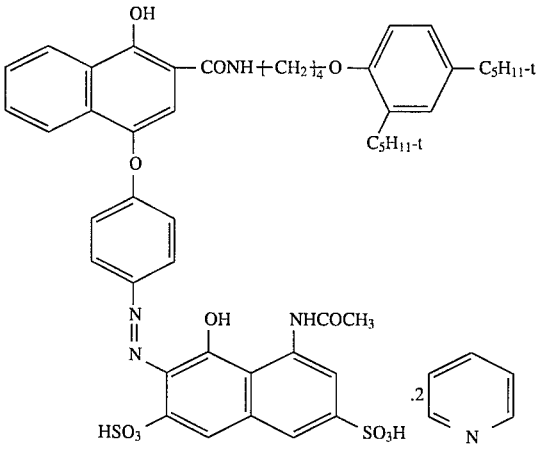

(6)

Further, any yellow dye-forming coupler can be used in the fast cyan layer. The yellow image dye-forming coupler is present for purposes of color correction to offset part of the inhibiting effect of the development inhibitor released in the cyan layer on the blue sensitive layers. The yellow image dye-forming coupler in the fast cyan layer is preferably less reactive than the yellow image dye-forming coupler in the mid cyan layer. The reactivities of the yellow image dye-forming couplers should be matched with reactivities of the DIR and/or DIAR in the corresponding fast cyan and mid cyan layers. In the present invention the yellow dye-forming coupler used in the fast cyan layer is preferably not a PUG containing coupler and can be the same as described with respect to such fast yellow layer with the preferred compound being the same as described with respect to such fast yellow layer.

MID CYAN LAYER

In the photographic element, the less sensitive red layer or mid cyan layer contains a cyan image dye-forming coupler, a timed development inhibitor releasing coupler, a magenta colored color correcting coupler, a bleach accelerator releasing coupler, and a yellow image dye-forming coupler.

The cyan image dye-forming coupler can be any cyan image dye-forming coupler useful in the photographic art. The cyan image dye-forming coupler is typically a phenol or naphthol coupler. Couplers that form cyan dyes upon reaction with oxidized color developing agents are described in such representative patents and publications as: U.S. Pat. Nos. 2,772,162; 3,476,563; 4,526,864; 4,500,635; 4,254,212; 4,296,200; 4,457,559; 2,895,826; 3,002,836; 3,034,892; 2,474,293; 2,801,171; 2,423,730; 2,367,531; 3,041,236; 4,443,536; 4,333,999; 4,124,396; 4,775,616; 3,779,763; 3,772,002; 3,419,390; 4,690,889; 3,996,253; and "Farbkuppler: Eine Literaturbersicht", published in Agfa Mitteilungen, Band III, pages 156–175 (1961), the disclosure of which is incorporated herein by reference.

A preferred cyan image dye-forming coupler for the cyan layers other than the fast cyan layer is:

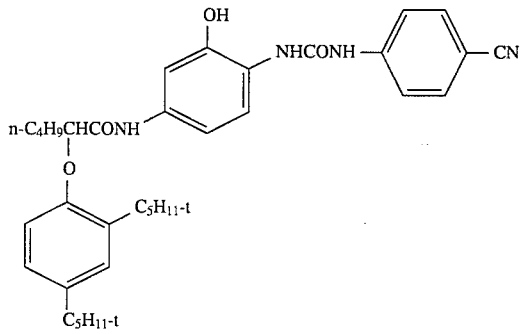

(5)

The DIAR which can be used can be any DIAR which will provide a timed development inhibitor release. That is, a development inhibitor releasing coupler containing at least one timing group (T) that enables timing of release of the development inhibitor group can be any development inhibitor releasing coupler containing at least one timing group known in the photographic art. The development inhibitor releasing coupler containing at least one timing group is represented by the formula:

$$\text{COUP-T}+\text{T}^1\frac{}{n}\text{Q}^1$$

wherein

COUP is a coupler moiety, as described, typically a cyan, magenta, or yellow dye-forming coupler moiety;

T and $T^1$ individually are timing groups, typically a timing group as described in U.S. Pat. Nos. 4,248,962 and 4,409,232, the disclosure of which are incorporated herein by reference;

n is 0 or 1;

$Q^1$ is a releasable development inhibitor group known in the photographic art. $Q^1$ can be selected from the INH group as described.

A preferred DIAR coupler of this type is described in U.S. Pat. No. 4,962,018, the disclosure of which is incorporated herein by reference.

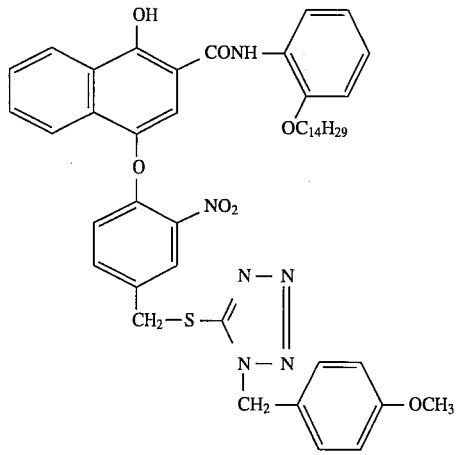

(14)

Suitable magenta colored color correcting "masking" couplers useful in the invention are as described for the most sensitive red layer with the preferred compound being the same as described with respect to such most sensitive red layer.

Suitable bleach accelerator releasing couplers useful in the invention are as described for the slow yellow layer with the preferred compound being the same as described with respect to such slow yellow layer.

Further, any yellow dye-forming coupler can be used in the mid cyan layer but preferrably the coupler does not contain a PUG. The yellow dye-forming coupler is present for purposes of color correction. The yellow image dye-forming coupler in the mid cyan layer is preferably more reactive than the yellow image dye-forming coupler in the fast cyan layer. The reactivities of the yellow image dye-forming couplers should be matched with reactivities of the DIR and/or DIAR, if any, in the corresponding fast cyan and mid cyan layers. In the present invention the yellow image dye-forming coupler used in the mid cyan layer can be the same as described with respect to such slow yellow layer with the preferred compound being the same as described with respect to such slow yellow layer.

INTERLAYER

In the photographic element the interlayer between the mid cyan layer and the slow magenta layer is comprised of any oxidized developer scavenger and a fine grain silver halide emulsion, preferably a Lippmann emulsion, known in the photographic art. Suitable oxidized developer scavenger compounds useful in the invention are as described for the interlayer between the fast yellow layer and the fast magenta layer with the preferred compound being the same as described with respect to such interlayer between the fast yellow layer and the fast magenta layer. This layer can also contain dyes to improve image sharpness and/or to tailor photographic sensitivity of the photographic elements below said layer.

SLOW MAGENTA LAYER

In the photographic element, the least sensitive green layer or slow magenta layer contains a magenta image dye-forming coupler and a bleach accelerator releasing coupler. Suitable magenta image dye-forming couplers useful in the invention are as described for the most sensitive green layer with the preferred compound being the same as described with respect to such most sensitive green layer.

Suitable bleach accelerator releasing couplers useful in the invention are as described for the slow yellow layer with the preferred compound being the same as described with respect to such slow yellow layer.

INTERLAYER

In the photographic element the interlayer between the slow magenta layer and the slow cyan layer is comprised of any oxidized developer scavenger known in the photographic art. Suitable oxidized developer scavenger compounds useful in the invention are as described for the interlayer between the fast yellow layer and the fast magenta layer with the preferred compound being the same as described with respect to such interlayer between the fast yellow layer and the fast magenta layer. This layer can also contain a dye to tailor photographic sensitivity of the photographic element below said layer.

SLOW CYAN LAYER

In the photographic element, the least sensitive red layer or slow cyan layer contains a cyan image dye-forming coupler, a magenta colored color correcting coupler, and a bleach accelerator releasing coupler. Suitable cyan image dye-forming couplers useful in the invention are as described for the mid cyan layer with the preferred compound being the same as described with respect to such mid cyan layer.

Suitable magenta colored color correcting couplers useful in the invention are as described for the most sensitive red layer with the preferred compound being the same as described with respect to such most sensitive red layer.

Suitable bleach accelerator releasing couplers useful in the invention are as described for the slow yellow layer with the preferred compound being the same as described with respect to such slow yellow layer.

ANTIHALATION LAYER

The antihalation layer can contain very fine gray or black silver filamentary or colloidal silver, e.g. yellow silver, and preferably a UV absorbing dye, gelatin and colored dye to provide density to the film.

EMULSIONS

In the present photographic element it is desired to obtain low contrast with low granularity. This is obtained by utilizing silver halide with high iodide content. In the mid cyan and fast cyan layers the mol % silver iodide in the emulsion can range from 6 to 14 mol % iodide, and preferably 8 to 13 mol % iodide. In the remaining fast layers the silver bromoiodide in the emulsion can range from 3 to 14 mol % iodide. The slow layers contain silver bromoiodide with an iodide content of 0 to 4 mol %. The iodide concentrations in the fast layer is particularly advantageous because it enables low contrast with low granularity.

If desired, the photographic element can be used in conjunction with an applied magnetic layer as described in *Research Disclosure,* November 1992, Item 34390 published by Kenneth Mason Publications, Ltd., Dudley Annex, 12a North Street, Emsworth, Hampshire P010 7DQ, ENGLAND.

In the following discussion of suitable materials for use in the emulsions and elements of this invention, reference will be made to *Research Disclosure,* December 1989, Item 308119, published by Kenneth Mason Publications, Ltd., Dudley Annex, 12a North Street, Emsworth, Hampshire P010 7DQ, ENGLAND, the disclosures of which are incorporated herein by reference. This publication will be identified hereafter by the term "Research Disclosure".

The silver halide emulsions employed in the elements of this invention can be negative-working. Suitable emulsions and their preparation are described in Research Disclosure Sections I and II and the publications cited therein. Suitable vehicles for the emulsion layers and other layers of elements of this invention are described in Research Disclosure Section IX and the publications cited therein.

In addition to the couplers generally described above, the elements of the invention can include additional couplers as described in Research Disclosure Section VII, paragraphs D, E, F and G and the publications cited therein. These couplers can be incorporated in the elements and emulsions as described in Research Disclosure Section VII, paragraph C and the publications cited therein.

The photographic elements of this invention or individual layers thereof, can contain brighteners (see Research Disclosure Section V), antifoggants and stabilizers (See Research Disclosure Section VI), antistain agents and image dye stabilizers (see Research Disclosure Section VII, paragraphs I and J), light absorbing and scattering materials (see Research Disclosure Section VIII), hardeners (see Research Disclosure Section IX), plasticizers and lubricants (See Research Disclosure Section XII), antistatic agents (see Research Disclosure Section XIII), matting agents (see Research Disclosure Section XVI) and development modifiers (see Research Disclosure Section XXI).

The photographic elements can be coated on a variety of supports as described in Research Disclosure Section XVII and the references described therein.

Other image dye-forming couplers may be included in the element. Couplers that form cyan dyes upon reaction with oxidized color developing agents are described in such representative patents and publications as: U.S. Pat. Nos. 2,772,162, 2,895,826, 3,002,836, 3,034,892, 2,474,293, 2,423,730, 2,367,531, 3,041,236, 4,883,746 and "Farbkuppler-eine LiteratureUbersicht," published in Agfa Mitteilungen, Band III, pp. 156–175 (1961). Preferably such couplers are phenols and naphthols that form cyan dyes on reaction with oxidized color developing agent.

Couplers that form magenta dyes upon reaction with oxidized color developing agent are described in such representative patents and publications as: U.S. Pat Nos. 2,600,788, 2,369,489, 2,343,703i 2,311,082, 3,152,896, 3,519,429, 3,062,653, 2,908,573 and "Farbkuppler-eine LiteratureUbersicht," published in Agfa Mitteilungen, Band III, pp. 126–156 (1961). Preferably such couplers are pyrazolones, pyrazolotriazoles, or pyrazolobenzimidazoles that form magenta dyes upon reaction with oxidized color developing agents.

Couplers that form yellow dyes upon reaction with oxidized and color developing agent are described in such representative patents and publications as: U.S. Pat. Nos. 2,875,057, 2,407,210, 3,265,506, 2,298,443, 3,048,194, 3,447,928 and "Farbkuppler-eine LiteratureUbersicht," published in Agfa Mitteilungen, Band III, pp. 112–126 (1961). Such couplers are typically open chain ketomethylene compounds.

For example, the invention materials may be substituted in whole or in part in the layers of a color negative photographic element comprising a support bearing the following layers from top to bottom:

(1) one or more overcoat layers containing ultraviolet absorber(s);

(2) a two-coat yellow pack with a fast yellow layer containing "Coupler 1": Benzoic acid, 4-chloro-3-((2-(4-ethoxy-2,5-dioxo-3-(phenylmethyl)-1 -imidazolidinyl)-3-(4-methoxyphenyl)-1,3-dioxopropyl)amino)-, dodecyl ester and a slow yellow layer containing the same compound together with "Coupler 2": Propanoic acid, 2-[[5-[[4-[2-[[[2,4-bis(1,1-dimethylpropyl)phenoxy]acetyl]amino]-5 -[(2,2,3,3,4,4,4-heptafluoro-1-oxobutyl)amino]-4-hydroxyphenoxy]-2,3-dihydroxy-6-[(propylamino)carbonyl]phenyl]thio]-1,3,4-thiadiazol-2-yl]thio]-, methyl ester and "Coupler 3": 1- ((dodecyloxy) carbonyl) ethyl (3-chloro-4-((3-(2-chloro-4-((1-tridecanoylethoxy) carbonyl)anilino)-3-oxo-2-((4)(5)(6)-(phenoxycarbonyl) -1H-benzotriazol-1-yl)propanoyl)amino))benzoate;

(3) an interlayer containing fine metallic silver;

(4) a triple-coat magenta pack with a fast magenta layer containing "Coupler 4": Benzamide, 3-((2-(2,4-bis(1,1-dimethylpropyl)phenoxy)-1-oxobutyl)amino)-N -(4,5-dihydro-5-oxo-1-(2,4,6-trichlorophenyl)-1H -pyrazol-3-yl)-, "Coupler 5": Benzamide, 3-((2-(2,4 -bis(1,1-dimethylpropyl)phenoxy)-1-oxobutyl)amino)-N -(4',5'-dihydro-5'-oxo-1'-(2,4,6-trichlorophenyl) (1,4'-bi-1H-pyrazol)-3'-yl)-, "Coupler 6": Carbamic acid, (6-(((3-(dodecyloxy) propyl) amino)carbonyl)-5-hydroxy-1-naphthalenyl)-, 2-methylpropyl ester, "Coupler 7": Acetic acid, ((2-((3-(((3-(dodecyloxy)propyl)amino) carbonyl)-4-hydroxy-8-(((2-methylpropoxy)carbonyl) amino) -1-naphthalenyl)oxy)ethyl)thio)-, and "Coupler 8" Benzamide, 3-((2-(2,4-bis(1,1-dimethylpropyl) phenoxy)-1-oxobutyl)amino)-N-(4,5-dihydro-4 -((4-methoxyphenyl) azo)-5-oxo-1-(2,4,6-trichlorophenyl)-1H -pyrazol-3-yl)-; a mid-magenta layer and a slow magenta layer each containing "Coupler 9": a ternary copolymer containing by weight in the ratio 1:1:2 2-Propenoic acid butyl ester, styrene, and N-[1-(2,4,6-trichlorophenyl) -4,5-dihydro-5-oxo-1H-pyrazol-3-yl]-2 -methyl-2-propenamide; and "Coupler 10": Tetradecanamide, N-(4-chloro-3-((4-((4-((2,2-dimethyl-1-oxopropyl) amino)phenyl)azo)-4,5-dihydro-5-oxo-1-(2,4,6-trichlorophenyl) -1H-pyrazol-3-yl)amino)phenyl)-, in addition to Couplers 3 and 8;

(5) an interlayer;

(6) a triple-coat cyan pack with a fast cyan layer containing Couplers 6 and 7; a mid-cyan containing Coupler 6 and "Coupler 11": 2,7-Naphthalenedisulfonic acid, 5-(acetylamino)-3-((4-(2-((3-(((3-(2,4-bis (1,1-dimethylpropyl)phenoxy) propyl)amino)carbonyl)-4-hydroxy-1-naphthalenyl) oxy)ethoxy)phenyl)azo)-4-hydroxy-, disodium salt; and a slow cyan layer containing Couplers 2 and 6;

(7) an undercoat layer containing Coupler 8; and (8) an antihalation layer.

The invention materials may also be used in association with materials that accelerate or otherwise modify the processing steps e.g. of bleaching or fixing to improve the quality of the image. Bleach accelerators described in EP 193,389; EP 301,477; U.S. Pat. Nos. 4,163,669; 4,865,956; and 4,923,784 are particularly useful. Also contemplated is use of the compositions in association with nucleating agents, development accelerators or their precursors (UK Patent 2,097,140; U.K. Patent 2,131,188); electron transfer agents (U.S. Pat. Nos. 4,859,578; 4,912,025); antifogging and anti color-mixing agents such as derivatives of hydroquinones, aminophenols, amines, gallic acid; catechol; ascorbic acid; hydrazides; sulfonamidophenols; and non color-forming couplers.

The invention materials may also be used in combination with filter dye layers comprising colloidal silver sol or yellow, cyan, and/or magenta filter dyes, either as oil-in-water dispersions, latex dispersions or as solid particle dispersions. Additionally, they may be used with "smearing" couplers (e.g. as described in U.S. Pat. No. 4,366,237; EP 96,570; U.S. Pat. Nos. 4,420,556; and 4,543,323.) Also, the compositions may be blocked or coated in protected form as described, for example, in Japanese Application 61/258,249 or U.S. Pat. No. 5,019,492.

The invention materials may further be used in combination with image-modifying compounds such as "Developer Inhibitor-Releasing" compounds (DIR's). DIR's useful in conjunction with the materials of the invention are known in the art and examples are described in U.S. Pat. Nos. 3,137,578; 3,148,022; 3,148,062; 3,227,554; 3,384,657; 3,379,529; 3,615,506; 3,617,291; 3,620,746; 3,701,783; 3,733,201; 4,049,455; 4,095,984; 4,126,459; 4,149,886; 4,150,228; 4,211,562; 4,248,962; 4,259,437; 4,362,878; 4,409,323; 4,477,563; 4,782,012; 4,962,018; 4,500,634; 4,579,816; 4,607,004; 4,618,571; 4,678,739; 4,746,600; 4,746,601; 4,791,049; 4,857,447; 4,865,959; 4,880,342; 4,886,736; 4,937,179; 4,946,767; 4,948,716; 4,952,485; 4,956,269; 4,959,299; 4,966,835; 4,985,336 as well as in patent publications GB 1,560,240; GB 2,007,662; GB 2,032,914; GB 2,099,167; DE 2,842,063, DE 2,937,127; DE 3,636,824; DE 3,644,416 as well as the following European Patent Publications: 272,573; 335,319; 336,411; 346, 899; 362,870; 365,252; 365,346; 373,382; 376,212; 377,463; 378,236; 384,670; 396,486; 401,612; 401,613.

Such compounds are also disclosed in "Developer-Inhibitor-Releasing (DIR) Couplers for Color Photography," C. R. Barr, J. R. Thirtle and P. W. Vittum in *Photographic Science and Engineering*, Vol. 13, p. 174 (1969), incorporated herein by reference. Generally, the developer inhibitor-releasing (DIR) couplers include a coupler moiety and an inhibitor coupling-off moiety (IN). The inhibitor-releasing couplers may be of the time-delayed type (DIAR couplers) which also include a timing moiety or chemical switch which produces a delayed release of inhibitor. Examples of typical inhibitor moieties are: oxazoles, thiazoles, diazoles, triazoles, oxadiazoles, thiadiazoles, oxathiazoles, thiatriazoles, benzotriazoles, tetrazoles, benzimidazoles, indazoles, isoindazoles, mercaptotetrazoles, selenotetrazoles, mercaptobenzothiazoles, selenobenzothiazoles, mercaptobenzoxazoles, selenobenzoxazoles, mercaptobenzimidazoles, selenobenzimidazoles, benzodiazoles, mercaptooxazoles, mercaptothiadiazoles, mercaptothiazoles, mercaptotriazoles, mercaptooxadiazoles, mercaptodiazoles, mercaptooxathiazoles, telleurotetrazoles or benzisodiazoles. In a preferred embodiment, the inhibitor moiety or group is selected from the following formulas:

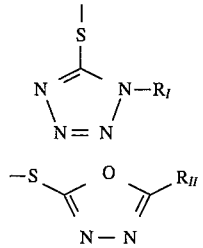

-continued

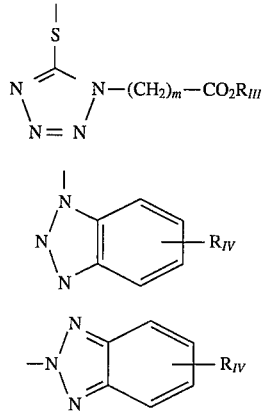

wherein $R_I$ is selected from the group consisting of straight and branched alkyls and alkoxy typically of from 1 to about 8 carbon atoms/benzyl and phenyl groups and said groups containing none, one, or more than one such substituent; $R_{II}$ is selected from $R_I$ and —$SR_I$; $R_{III}$ is a straight or branched alkyl group of from 1 to about 5 carbon atoms and m is from 1 to 3; and $R_{IV}$ is selected from the group consisting of hydrogen, halogens and alkoxy, phenyl and carbonamido groups, —$COOR_V$ and —$NHCOOR_V$ wherein $R_V$ is selected from substituted and unsubstituted alkyl and aryl groups.

Although it is typical that the coupler moiety included in the developer inhibitor-releasing coupler forms an image dye corresponding to the layer in which it is located, it may also form a different color as one associated with a different film layer. It may also be useful that the coupler moiety included in the developer inhibitor-releasing coupler forms colorless products and/or products that wash out of the photographic material during processing (so-called "universal" couplers).

As mentioned, the developer inhibitor-releasing coupler may include a timing group which produces the time-delayed release of the inhibitor group such as groups utilizing the cleavage reaction of a hemiacetal (U.S. Pat. No. 4,146,396, Japanese Applications 60-249148; 60-249149); groups using an intramolecular nucleophilic substitution reaction (U.S. Pat. No. 4,248,962); groups utilizing an electron transfer reaction along a conjugated system (U.S. Pat. No. 4,409,323; 4,421,845; Japanese Applications 57-188035; 58-98728; 58-209736; 58-209738) groups utilizing ester hydrolysis (German Patent Application (OLS) No. 2,626,315; groups utilizing the cleavage of imino ketals (U.S. Pat. No. 4,546,073); groups that function as a coupler or reducing agent after the coupler reaction (U.S. Pat. Nos. 4,438,193; 4,618,571) and groups that combine the features describe above. It is typical that the timing group or moiety is of one of the formulas:

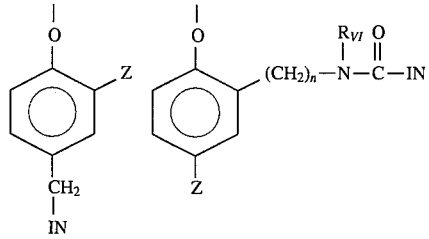

wherein IN is the inhibitor moiety, Z is selected from the group consisting of nitro, cyano, alkylsulfonyl; sulfamoyl (—$SO_2NR_2$); and sulfonamido (—$NRSO_2R$) groups; n is 0 or 1; and $R_{VI}$ is selected from the group consisting of substituted and unsubstituted alkyl and phenyl groups. The oxygen atom of each timing group is bonded to the coupling-off position of the respective coupler moiety of the DIAR.

Suitable developer inhibitor-releasing couplers for use in the present invention include, but are not limited to, the following:

D1

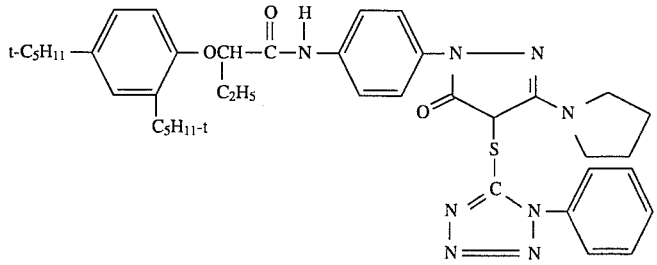

D2

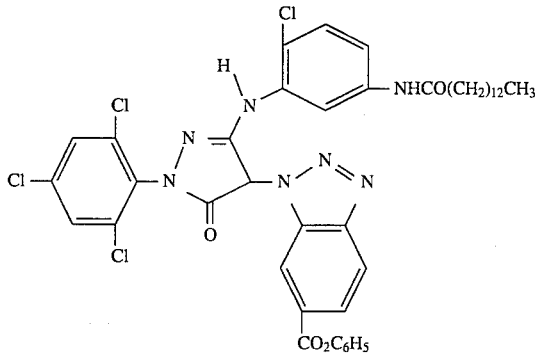

D3

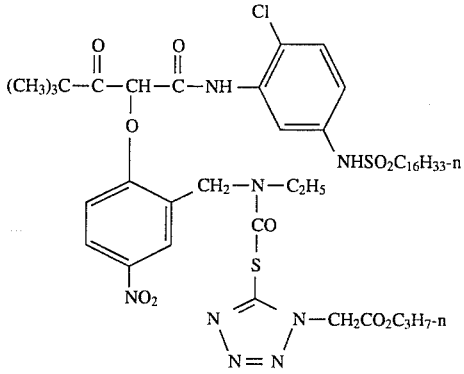

D4

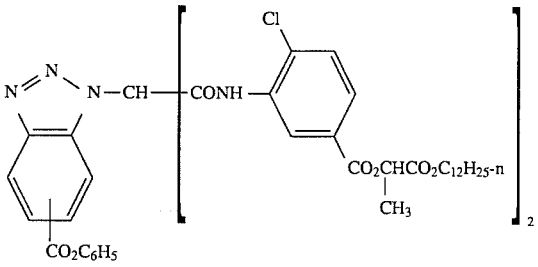

D5

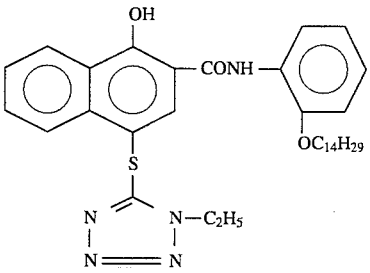

-continued

D6

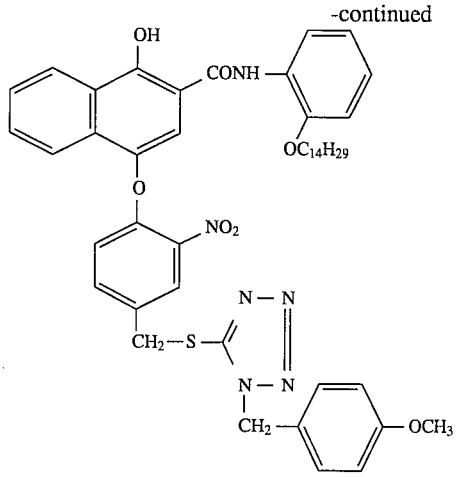

D7

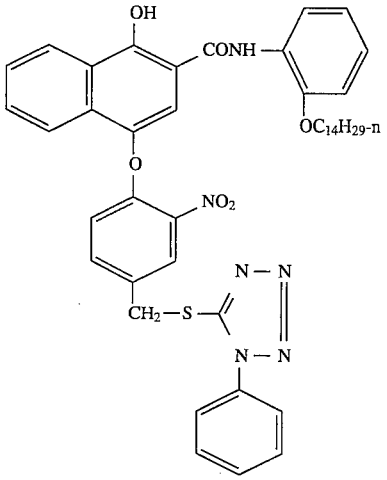

D8

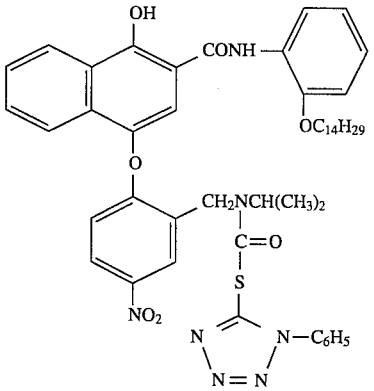

It is also contemplated that the concepts of the present invention may be employed to obtain reflection color prints as described in *Research Disclosure,* November 1979, Item 18716, available from Kenneth Mason Publications, Ltd, Dudley Annex, 12a North Street, Emsworth, Hampshire P0101 7DQ, England, incorporated herein by reference. Materials of the invention may be coated on pH adjusted support as described in U.S. Pat. No. 4,917,994; with epoxy solvents (EP 0 164 961); with nickel complex stabilizers (U.S. Pat. Nos. 4,346,165; 4,540,653 and 4,906,559 for example); with ballasted chelating agents such as those in U.S. Pat. No. 4,994,359 to reduce sensitivity to polyvalent cations such as calcium; and with stain reducing compounds such as described in U.S. Pat. Nos. 5,068,171 and 5,096,805. Other compounds useful in combination with the invention are disclosed in Japanese Published Applications 83-09,959; 83-062,586; 90-072,629, 90-072,630; 90-072,632; 90-072,633; 90-072,634; 90-077,822; 90-078,229; 90-078,230; 90-079,336; 90-079,338; 90-079,690; 90-079,691; 90-080,487; 90-080,489; 90-080,490; 90-080,491; 90-080,492; 90-080,494; 90-085,928; 90-086,669; 90-086,670; 90-087,361; 90-087,362; 90-087,363; 90-087,364; 90-088,096; 90-088,097; 90-093,662; 90-093,663; 90-093,664; 90-093,665; 90-093,666; 90-093,668; 90-094,055; 90-094,056; 90-101,937; 90-103,409; 90-151,577.

Especially useful in this invention are tabular grain silver halide emulsions. Specifically contemplated tabular grain emulsions are those in which greater than 50 percent of the total projected area of the emulsion grains are accounted for in the case of silver bromide or silver bromoiodide by tabular grains having a thickness of less than 0.3 micron (0.5 micron for blue sensitive emulsion) and an average tabularity (T) of greater than 25 (preferably greater than 100), where the term "tabularity" is employed in its art recognized usage as $$T=ECD/t^2$$

where

ECD is the average equivalent circular diameter of the tabular grains in micrometers and t is the average thickness in micrometers of the tabular grains.

The average useful ECD of photographic emulsions can range up to about 10 micrometers, although in practice emulsion ECD's seldom exceed about 4 micrometers. Since both photographic speed and granularity increase with increasing ECD's, it is generally preferred to employ the smallest tabular grain ECD's compatible with achieving aim speed requirements.

Emulsion tabularity increases markedly with reductions in tabular grain thickness. It is generally preferred that aim tabular grain projected areas be satisfied by thin (t<0.2 micrometers) tabular grains. To achieve the lowest levels of granularity it is preferred that aim tabular grain projected areas be satisfied with ultrathin (t<0.06 micrometers) tabular grains. Tabular grain thicknesses typically range down to about 0.02 micrometers. However, still lower tabular grain thicknesses are contemplated. For example, Daubendiek et al U.S. Pat. No. 4,672,027 reports a 3 mole percent iodide tabular grain silver bromoiodide emulsion having a grain thickness of 0.017 micronmeters. Ultrathin tabular grain high chloride emulsions are disclosed by Maskasky U.S. Ser. No. 763,030 filed Sep. 20. 1991, now allowed.

As noted above tabular grains of less than the specified thickness account for at least 50 percent of the total grain projected area of the emulsion. To maximize the advantages of high tabularity it is generally preferred that tabular grains satisfying the stated thickness criterion account for the highest conveniently attainable percentage of the total grain projected area of the emulsion. For example, in preferred emulsions, tabular grains satisfying the stated thickness criteria above account for at least 70 percent of the total grain projected area. In the highest performance tabular grain emulsions, tabular grains satisfying the thickness criteria above account for at least 90 percent of total grain projected area.

Suitable tabular grain emulsions can be selected from among a variety of conventional teachings, such as those of the following: Research Disclosure, Item 22534, January 1983, published by Kenneth Mason Publications, Ltd., Emsworth, Hampshire P010 7DD, England; U.S. Pat. Nos. 4,439,520; 4,414,310; 4,433,048; 4,643,966; 4,647,528; 4,665,012; 4,672,027; 4,678,745; 4,693,964; 4,713,320; 4,722,886; 4,755,456; 4,775,617; 4,797,354; 4,801,522; 4,806,461; 4,835,095; 4,853,322; 4,914,014; 4,962,015; 4,985,350; 5,061,069,5,061,616, 5,210,013 and PCT Serial No. 93/06521, published Apr. 1, 1993.

Photographic elements can be exposed to actinic radiation, typically in the visible region of the spectrum, to form a latent image as described in Research Disclosure Section XVIII and then processed to form a visible dye image as described in Research Disclosure Section XIX. Processing to form a visible dye image includes the step of contacting the element with a color developing agent to reduce developable silver halide and oxidize the color developing agent. Oxidized color developing agent in turn reacts with the coupler to yield a dye.

With negative working silver halide, the processing step described above gives a negative image.

Development is followed by the conventional steps of bleaching, fixing, or bleach-fixing, to remove silver and silver halide, washing and drying.

EXAMPLE 1

A three color photographic film was prepared as follows using conventional surfactants, antifoggants and the materials indicated. After providing a developable image and then processing in accordance with the Kodak C-41 process (British Journal of Photography, pp. 196–198 (1988) excellent results e.g. improved color, sharpness, granularity and neutral scale, were obtained.

| Support | mg/m$^2$ | mg/ft$^2$ | |
|---|---|---|---|
| Layer 1 | | | |
| Antihalation Layer | 322.8 | 30.0 | Black filamentary silver |
| | 91.46 | 8.5 | UV absorbing dye (1) |
| | 2421. | 225.0 | Gelatin |
| Layer 2 | | | |
| Interlayer | 53.8 | 5.0 | D-Ox scavenging coupler (2) |
| | 645.6 | 60.0 | Gelatin |
| Layer 3 | | | |
| Least Red Layer | 340.0 | 31.6 | Slow Ag Br/I emulsion containing 3.3 mole % iodide and 217 mg of sensitizing dye (3) and 91 mg of sensitizing dye (4) per mole of silver halide |
| | 414.3 | 38.5 | Cyan dye forming coupler (5) |
| | 21.52 | 2.0 | Cyan dye forming, magenta colored, masking coupler (6) |
| | 32.28 | 3.0 | Cyan dye forming development/bleach accelerator ("BARC") (7) |
| | 59.18 | 5.5 | Red filter dye (8) |
| | 1829. | 170.0 | Gelatin |
| Layer 4 | | | |
| Interlayer | 107.6 | 10.0 | D-Ox scavenging coupler (2) |
| | 5.38 | 0.5 | Preformed Yellow dye (9) |
| | 21.52 | 2.0 | Preformed Cyan dye (10) |
| | 645.6 | 60.0 | Gelatin |
| Layer 5 | | | |
| Least Green Layer | 137.7 | 12.8 | Slow Ag Br/I emulsion containing 3.3 mole % iodide and 523 mg of sensitizing dye (11) and 151 mg of sensitizing dye (12) per mole of silver halide |
| | 444.4 | 41.3 | Slow Ag Br/I emulsion containing 3.4 mole % iodide and 859 mg of sensitizing dye (11) and 249 mg of sensitizing dye (12) per mole of silver halide |
| | 269 | 25.0 | Magenta dye forming |

-continued

| Support | mg/m² | mg/ft² | |
|---|---|---|---|
| | | | coupler (13) |
| | 5.38 | 0.5 | Cyan dye forming BARC coupler (7) |
| | 48.42 | 4.5 | Red filter dye (8) |
| | 914.6 | 85.0 | Gelatin |
| Layer 6 | | | |
| Interlayer | 161.4 | 15.0 | Lippmann Ag Br emulsion |
| | 107.6 | 10.0 | D-Ox scavenging coupler (2) |
| | 645.6 | 60.0 | Gelatin |
| Layer 7 | | | |
| Mid Red Layer | 882.3 | 82.0 | Fast Ag Br/I T-grain emulsion containing 12.27 mole % iodide and 163 mg of sensitizing dye (3) and 67 mg of sensitizing dye (4) per mole of silver halide |
| | 193.7 | 18.0 | Cyan dye forming coupler (5) |
| | 64.6 | 6.0 | Cyan dye forming development inhibitor anchimeric releasing coupler ("DIAR") (14) |
| | 64.6 | 6.0 | Yellow dye forming coupler (24) |
| | 53.8 | 5.0 | Cyan dye forming, magenta colored, masking coupler (6) |
| | 10.76 | 1.0 | Cyan dye forming BARC coupler (7) |
| | 5.38 | 0.5 | Green filter dye (15) |
| | 1622. | 150.7 | Gelatin |
| Layer 8 | | | |
| Most Sensitive Red Layer | 333.6 | 31.0 | Fast Ag Br/I T-grain emulsion containing 8.18 mole % iodide and 188 mg of sensitizing dye (3) and 78 mg of sensitizing dye (4) per mole of silver halide |
| | 43.0 | 4.0 | Fast Ag Br/I T-grain emulsion containing 12.27 mole % iodide and 163 mg of sensitizing dye (3) and 67 mg of sensitizing dye (4) per mole of silver halide |
| | 59.2 | 5.5 | Yellow dye forming coupler (16) |
| | 21.5 | 2.0 | Cyan dye forming, magenta colored, masking coupler (6) |
| | 23.7 | 2.2 | Cyan dye forming development inhibitor releasing coupler ("DIR") (17) |
| | 538. | 50.0 | Gelatin |
| Layer 9 | | | |
| Interlayer | 107.6 | 10.0 | D-Ox scavenging coupler (2) |
| | 10.76 | 1.0 | Preformed Cyan dye (10) |
| | 645.6 | 60.0 | Gelatin |
| Layer 10 | | | |
| Most Sensitive Green Layer | 269. | 25.0 | Fast Ag Br/I T-grain emulsion containing 8.18 mole % iodide and 455 mg of sensitizing dye (11) and 126 mg of sensitizing dye (12) per mole of silver halide |
| | 817.8 | 76.0 | Fast Ag Br/I T-grain emulsion containing 12.27 mole % iodide and 804 mg of sensitizing dye (11) and 151 mg of sensitizing dye (12) per mole of silver halide |
| | 182.9 | 17.0 | Slow Ag Br/I emulsion containing 3.3 mole % iodide and 523 mg of sensitizing dye (11) and 151 mg of sensitizing dye (12) per mole of silver halide |
| | 408.9 | 38.0 | Magenta dye forming coupler (13) |
| | 32.3 | 3.0 | Yellow dye forming DIAR (18) |
| | 53.8 | 5.0 | Magenta dye forming, yellow colored, masking coupler (19) |
| | 16.1 | 1.5 | magenta dye forming DIR coupler (20) |
| | 21.5 | 2.0 | Preformed Cyan dye (10) |
| | 2475. | 230.0 | Gelatin |
| Layer 11 | | | |
| Yellow Colloidal Silver Filter Layer | 107.6 | 10.0 | D-Ox scavenging coupler (2) |
| | 118.4 | 11.0 | Yellow Colloidal Silver (Carey Lee silver) |
| | 1076. | 100.0 | Gelatin |
| Layer 12 | | | |
| Most Sensitive Blue Layer | 139.9 | 13.0 | Fast Ag Br/I T-grain emulsion containing 8.18 mole % iodide and 620 mg of sensitizing dye (22) per mole of silver halide |
| | 139.9 | 13.0 | Fast Ag Br/I T-grain emulsion containing 3.0 mole % iodide and 900 mg of sensitizing dye (22) per mole of silver halide |
| | 226. | 21.0 | Fast Ag Br/I T-grain emulsion containing 3.0 mole % iodide and 800 mg of sensitizing dye (22) per mole of silver halide |
| | 312.0 | 29.0 | Yellow dye forming coupler (16) |
| | 161.4 | 15.0 | Yellow dye forming DIAR (18) |
| | 10.76 | 1.0 | Cyan dye forming BARC coupler (7) |
| | 64.56 | 6.0 | Preformed Yellow dye coupler (9) |
| | 43.0 | 4.0 | Blue filter dye (23) |
| | 2335. | 217.0 | Gelatin |
| Layer 13 | | | |
| Least Sensitive Blue Layer | 242.1 | 22.5 | Slow Ag Br/I emulsion containing 3.3 mole % iodide and 1254 mg of |

| Support | mg/m² | mg/ft² | |
|---|---|---|---|
| | | | sensitizing dye (22) per mole of silver halide |
| | 564.9 | 52.5 | Yellow dye forming coupler (24) |
| | 5.38 | 0.5 | Cyan dye forming BARC coupler (7) |
| | 807. | 75.0 | Gelatin |
| Layer 14 | 430.4 | 40.0 | Lippmann Ag Br emulsion |
| | 107.6 | 10.0 | UV absorbing dye (25) |

| Support | mg/m² | mg/ft² | |
|---|---|---|---|
| | 37.66 | 3.5 | UV absorbing dye (1) |
| | 16.14 | 1.5 | Preformed Magenta dye coupler (27) |
| | 699.4 | 65.0 | Gelatin |
| Layer 15 | | | |
| Protective | 45.19 | 4.2 | First matting agent |
| Gelatin | 32.28 | 3.0 | Second matting agent |
| Overcoat | 882.3 | 82.0 | Gelatin |

Formulas not previously identified are as follows:

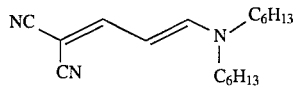

(1)

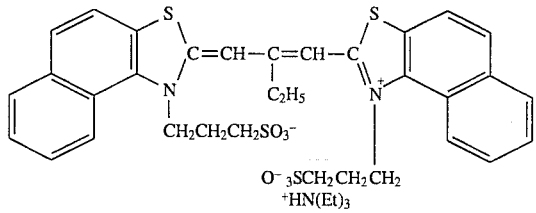

(3)

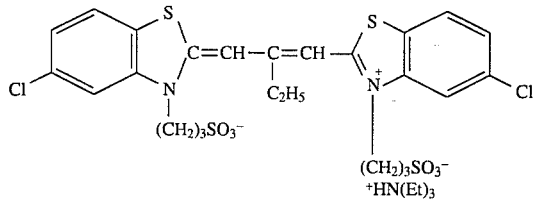

(4)

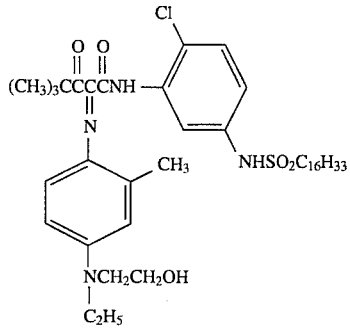

(9)

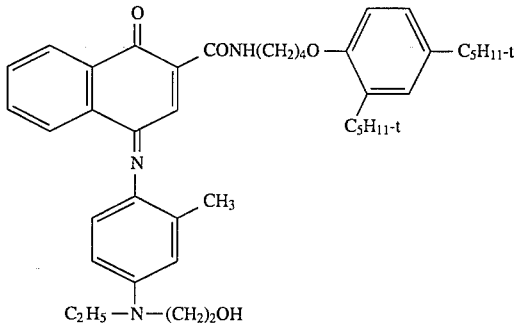

(10)

-continued
(11)
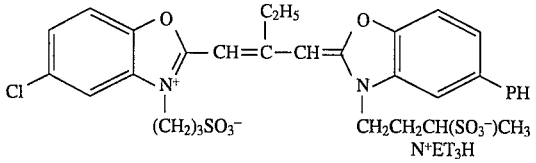
(12)
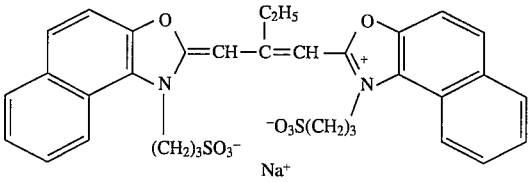
(15)
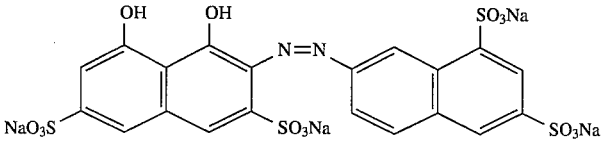
(22)
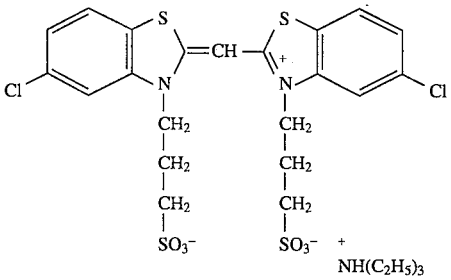
(23)
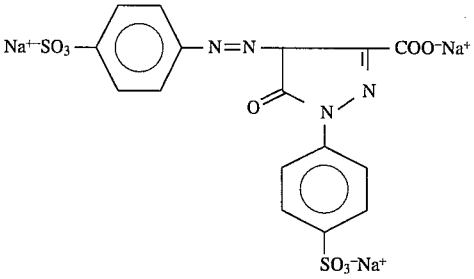
(25)
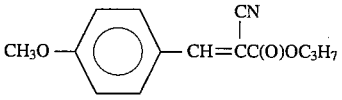
(26)
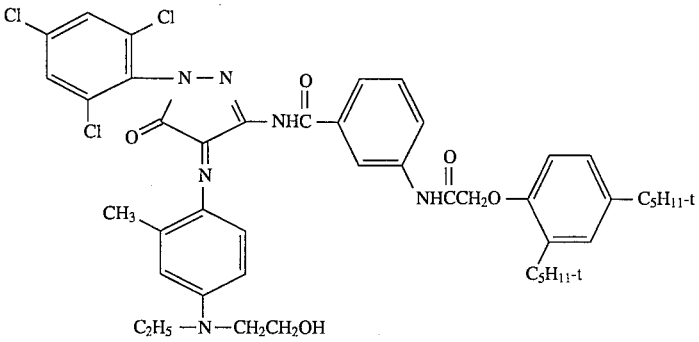

-continued (27)

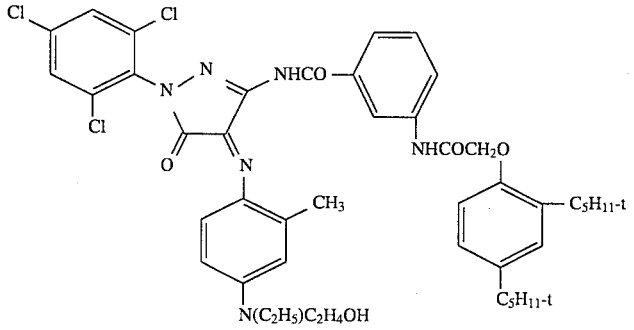

EXAMPLE 2

A photographic film was prepared with a layer order as described in Example 1. For comparison purposes, a similar film was prepared with the exception being that the most red sensitive layer and the mid red sensitive layer were combined into a single layer. This "condensed" red layer occupied the same place in the layer arrangement as did the two layers from which it was made. The combined layers contained 957 mg/m$^2$ of silver with a weight ratio of image dye-forming coupler to silver of 0.258 and a combined ratio of all dye-forming couplers to silver of 0.427. (The corresponding figures for the fast layer of the triple coat were 301 mg/m$^2$ silver, ratio 0.071 and combined ratio 0.143.) Adjustments were made so that the two film elements had similar lower scale gammas in the red record. The most red sensitive layer of the element having contiguous layers had 21.5 mg/m$^2$ of cyan coupler present. The grain for each of the elements was measured at 0.2 density units above Dmin. It was found that there was a grain improvement of 4 grain units for the element having the three layer arrangement.

EXAMPLE 3

Additional samples were prepared as above having three red sensitive layers. In these samples, the control set had 43 mg/m$^2$ of cyan image dye-forming and 301 mg/m$^2$ of silver giving a weight ratio of 0,143 image coupler to silver. When also considering the 5.4 mg/m$^2$ of development inhibitor releasing coupler, the combined ratio of all dye-forming couplers to silver was 0.161. On the other hand, the samples of the invention were extremely starved and contained no image dye-forming coupler (a ratio of 0.0) and contained the same quantity of development inhibitor releasing coupler-(combined ratio 0,018.) The samples were compared for granularity and it was found that there was a grain advantage of 3.5 grain units for the film containing the extremely starved most red sensitive layer arrangement.

The invention has been described in detail with particular reference to preferred embodiments thereof, but it will be understood that the invention includes variations and modifications within the spirit and scope of the invention.

What is claimed is:

1. A multilayered color photographic element comprising a support having coated thereon photographic silver halide emulsion layers said layers including at least three layers each having the same spectral sensitivity but having, respectively, the most, mid, and least light sensitivity wherein the most and mid sensitive layers are contiguous and the most sensitive layer is substantially free of image dye-forming coupler.

2. The element of claim 1 wherein said most sensitive layer is adjacent to at least one most sensitive layer of different color sensitivity.

3. The element of claim 1 wherein the weight combined ratio of (1) the total of all image dye-forming and PUG releasing couplers to (2) the silver halide (expressed as silver) is less than 0.30.

4. The element of claim 3 wherein said most sensitive layer is adjacent to at least one most sensitive layer of different color sensitivity.

5. The element of claim 1 wherein the element comprises a development inhibitor releasing coupler.

6. The element of claim 1 wherein the element comprises a masking coupler.

7. The element of claim 1 wherein the most sensitive layer includes a coupler which forms a dye having a different spectral absorption range than the dyes formed from the image dye-forming couplers contained in the mid and least sensitive layers of the same spectral sensitivity.

8. The element of claim 1 wherein the least and mid sensitive layers are sensitized to green light.

9. The element of claim 1 wherein the least and mid sensitive layers are sensitized to red light.

10. The element of claim 1 wherein the least and mid sensitive layers are sensitized to blue light.

11. The element of claim 1 wherein the least sensitive layer is adjacent to the mid sensitive layer.

12. The element of claim 1 wherein the least sensitive layer is contiguous to the mid sensitive layer.

13. A multilayer photographic element comprising a support having coated thereon photographic silver halide emulsion layers the element being comprised of a plurality of blue sensitive silver halide emulsion layers, with one of the blue sensitive layers being more sensitive than another less blue sensitive layer, at least three red sensitive silver halide emulsion layers having a first or most red sensitive layer being more sensitive than a second or mid red sensitive layer which is more sensitive than a third or least red sensitive layer, a plurality of green sensitive silver halide emulsion layers with one of the green sensitive layers being more green sensitive than another or least green sensitive layer, the layers arranged with (a) the least red sensitive layer being a photographic emulsion layer closest to the support (b) the least green sensitive layer adjacent said least red sensitive layer (c) the mid red sensitive layer adjacent said least green sensitive layer and contiguous said most red sensitive layer and (d) the most red sensitive layer being a coupler starved layer and being free of cyan image dye-forming coupler.

14. The photographic element in accordance with claim 13 wherein the blue sensitive halide layers are the emulsion layers farthest from the support.

15. The photographic element in accordance with claim 13 wherein the less blue sensitive layer is the emulsion layer farthest from the support.

16. The photographic element in accordance with claim 13 wherein the more blue sensitive layer is the emulsion layer farthest from the support.

17. The photographic element in accordance with claim 13 wherein the most green sensitive layer is interposed between the most red sensitive layer and a blue sensitive layer.

18. A process of forming a developed image in an exposed color photographic element as defined in claim 13 comprising developing said element with a color developer.

19. The element in accordance with claim 13 wherein the first red sensitive and second red sensitive layers comprise silver bromoiodide containing 6 to 14 mol % iodide.

20. A multilayer color photographic element in accordance with claim 13 wherein the first red sensitive and second red sensitive layers comprise silver bromoiodide containing 8 to 13 mol % iodide.

* * * * *